US009380390B2

(12) United States Patent
Prokisch

(10) Patent No.: US 9,380,390 B2
(45) Date of Patent: Jun. 28, 2016

(54) LOUDSPEAKER

(71) Applicant: Harman Becker Automotive Systems GmbH, Karlsbad (DE)

(72) Inventor: Joerg Prokisch, Karlsbad (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 14/675,051

(22) Filed: Mar. 31, 2015

(65) Prior Publication Data

US 2015/0289039 A1 Oct. 8, 2015

(30) Foreign Application Priority Data

Apr. 2, 2014 (DE) ..... 20 2014 003 034 U

(51) Int. Cl.
*H04R 9/02* (2006.01)
*H04R 31/00* (2006.01)
*H04R 1/00* (2006.01)

(52) U.S. Cl.
CPC ..... *H04R 9/022* (2013.01); *H04R 1/00* (2013.01); *H04R 9/025* (2013.01); *H04R 31/006* (2013.01); *H04R 2209/024* (2013.01); *H04R 2400/07* (2013.01); *H04R 2400/11* (2013.01)

(58) Field of Classification Search
CPC ..... H04R 1/025; H04R 1/026; H04R 1/066; H04R 1/2884; H04R 1/2888; H04R 1/2892; H04R 1/2896; H04R 7/22; H04R 9/02; H04R 9/022; H04R 9/025; H04R 31/003; H04R 31/006; H04R 2201/029; H04R 2209/024; H04R 2400/07; H04R 2400/11
See application file for complete search history.

(56) References Cited

U.S. PATENT DOCUMENTS 3,430,007 A * 2/1969 Thielen ..... H04R 9/066 381/152
3,666,040 A * 5/1972 Junk ..... H04R 1/025 181/150
4,387,788 A * 6/1983 Slavin ..... H04R 11/14 181/148
4,403,120 A * 9/1983 Yoshimi ..... H04R 1/225 181/129
4,506,117 A * 3/1985 Fresard ..... H04R 9/066 181/150
4,520,237 A * 5/1985 Murakami ..... H04R 1/06 381/412
4,546,850 A * 10/1985 Litner ..... H04R 1/025 181/141
4,742,887 A * 5/1988 Yamagishi ..... H04R 1/2857 181/129

(Continued)

FOREIGN PATENT DOCUMENTS

DE 1950188 A1 5/1971
DE 8016205 U1 9/1980

(Continued)

OTHER PUBLICATIONS

Search Report completed by UKIPO on Jul. 8, 2015 for counterpart foreign application GB1505453.9, 2 pages.

*Primary Examiner* — Curtis Kuntz
*Assistant Examiner* — Joshua Kaufman
(74) *Attorney, Agent, or Firm* — Brooks Kushman P.C.

(57) ABSTRACT

A loudspeaker including a loudspeaker frame, a magnet, and a ring is provided. The magnet includes an outer surface and a shoulder. The ring includes an inner surface that is constructed so as to form a press fit with the outer surface of the magnet. In the press fit, the loudspeaker frame is clamped between the shoulder of the magnet and the ring.

11 Claims, 2 Drawing Sheets

(56) References Cited

U.S. PATENT DOCUMENTS 5,150,419 A * 9/1992 Kizak ..... H04R 1/025 381/412
5,243,151 A * 9/1993 Prokisch ..... H04R 9/02 181/171
5,303,209 A * 4/1994 Frasl ..... H04R 9/02 181/160
5,524,151 A * 6/1996 Bleim ..... H04R 9/06 381/345
5,539,262 A * 7/1996 Strugach ..... H02K 41/0356 310/12.16
5,727,077 A * 3/1998 Frasl ..... H04R 9/06 381/345
5,909,015 A * 6/1999 Yamamoto ..... H04R 9/022 181/156
6,075,866 A * 6/2000 Frasl ..... H04R 9/02 181/171
6,178,252 B1 * 1/2001 Frasl ..... H04R 7/12 181/164
6,430,300 B1 * 8/2002 Cox ..... H04R 9/022 181/199
6,510,232 B2 * 1/2003 Frasl ..... H04R 7/14 381/423
6,601,645 B1 * 8/2003 Abdo ..... H04R 9/022 165/185
6,804,366 B2 * 10/2004 Takahashi ..... H04R 9/06 381/397
6,810,128 B2 * 10/2004 Kaneda ..... B06B 1/045 340/388.1
7,167,573 B2 * 1/2007 Williamson ..... H04R 9/06 381/398
7,965,856 B2 * 6/2011 Sato ..... H04R 9/06 381/396
8,090,138 B2 * 1/2012 Toyama ..... B60R 11/0223 381/365
9,154,864 B1 * 10/2015 Sell ..... H04R 1/02
2002/0067842 A1 * 6/2002 Takahashi ..... H04R 9/06 381/379
2005/0152573 A1 * 7/2005 Suzuki ..... H04R 9/025 381/412
2005/0224281 A1 * 10/2005 Gordon ..... H04R 1/025 181/153
2006/0072248 A1 * 4/2006 Watanabe ..... H04R 9/066 360/318
2007/0121994 A1 * 5/2007 Hayasaka ..... H04R 9/06 381/420
2008/0285769 A1 * 11/2008 Toyama ..... B60R 11/0223 381/86
2009/0060250 A1 * 3/2009 Proni ..... H04R 9/06 381/396
2009/0136065 A1 * 5/2009 Yano ..... H04R 1/24 381/186
2010/0322459 A1 * 12/2010 Winter ..... H04R 9/025 381/411
2012/0020479 A1 * 1/2012 Zhang ..... H04R 9/025 381/17
2012/0169144 A1 * 7/2012 Wei ..... H04R 9/025 310/10
2014/0054984 A1 * 2/2014 Tang ..... H02K 33/18 310/28
2015/0078605 A1 * 3/2015 Yang ..... H04R 1/2888 381/353
2015/0289039 A1 * 10/2015 Prokisch ..... H04R 1/00 381/412

FOREIGN PATENT DOCUMENTS

DE 202014003034 U 5/2015
JP S588292 U 7/1956
JP S5819598 U 7/1956
WO 99/41940 A1 8/1999

* cited by examiner

LOUDSPEAKER

CROSS-REFERENCE TO RELATED APPLICATIONS

This application claims priority to DE Application No. 202014003034.0, filed Apr. 2, 2014, the disclosure of which is incorporated in its entirety by reference herein.

TECHNICAL FIELD

The present invention relates to a loudspeaker.

BACKGROUND

A dynamic loudspeaker operates according to the electrodynamic principle. This sound transducer is also designated as an electrodynamic loudspeaker. Cone loudspeakers are dynamic loudspeakers known as moving coil loudspeakers. The drive of the loudspeaker is designated as a magnet, wherein the magnet can comprise several components such as a magnetic disk, pole disk, magnetic pot, etc.

A loudspeaker with a loudspeaker frame and a magnet is known from DE 1 950 188 A1. DE 80 16 205 U1 shows a loudspeaker with a loudspeaker frame, an upper plate and a permanent magnet. The upper plate has hollow rivets for fastening the loudspeaker frame on the upper side which rivets are formed by pressing in recesses on the opposing side of the upper plate. The permanent magnet is adhered to the underside of the upper plate.

SUMMARY

The invention is based on the object to improve a speaker.

This object is achieved by a loudspeaker with the features of the independent claim 1. Advantageous further developments form subject matter of dependent claims and are contained in the specification.

Accordingly, a loudspeaker with a loudspeaker frame and with a magnet and a ring is provided.

The magnet has an outer surface.

The magnet has a shoulder.

The ring has an inner surface that is constructed so as to form a press fit with the outer surface of the magnet.

In a press fit, the loudspeaker frame is clamped between the shoulder of the magnet and the ring.

Several advantages are achieved by concrete changes such as are explained, for example, in the exemplary embodiments of the figures. The mounting of the fastening between the loudspeaker frame and the magnet can take place with the movement for producing the press fit. Cycle times during the manufacture can be distinctly reduced by this fastening of the magnet and the loudspeaker frame by the ring and consequently the productivity can be significantly increased in comparison to other fastening types such as, for example, injection.

The further developments described in the following can be combined with each other. In particular, they can further improve the thermal properties of the loudspeaker.

According to an advantageous embodiment, the inner surface of the ring and the outer surface of the magnet are conically formed. The conical outer surface can also be designated as a shell. In a press fit the conical inner surface of the ring is pressed onto the conical outer surface of the magnet. This can also be designated as a conical press fit.

According to another advantageous embodiment, the ring is constructed as a cooling body (or heat sink) for reducing a thermal resistance between the magnet and the ambient air.

According to an advantageous embodiment, a material of the ring is the same as a material of the magnet in the area of the outer surface of the magnet. The material of the ring and the material of the magnet are advantageously identical in the area of the outer surface. For example, the material is a metal, preferably a magnetically conductive material, in particular including iron.

According to an advantageous embodiment, the loudspeaker frame comprises a number of openings in the area of the magnet. In particular of a magnetic pot of the magnet that is covered by the ring. The loudspeaker frame preferably has a plurality of openings in the area. The openings are preferably smaller than the covering width of the ring.

According to an advantageous embodiment, the loudspeaker comprises a centering that is fastened on the loudspeaker frame. The loudspeaker advantageously has a volume that is limited by the centering, the magnet, and the loudspeaker frame. The volume is preferably formed in such a manner that during operation, air flow is generated through the number of openings by a change of the volume.

According to an advantageous embodiment, in a press fit, a slot is formed in the area of the openings between the loudspeaker frame and the ring. The slot prevents a penetration of particles of dirt and at the same time enables convection for cooling by air flow through the slot.

According to an advantageous embodiment, the magnet comprises a magnetic pot, wherein the magnetic pot forms the outer surface and/or the shoulder.

According to an advantageous embodiment, the outer surface of the magnet is produced by turning or extrusion. This can achieve low tolerance values of the outer surface for the press fit.

According to an advantageous embodiment, the ring is formed by deep drawing.

According to an advantageous embodiment, the ring is formed from steel sheeting.

According to an advantageous embodiment, the ring is L-shaped.

According to an advantageous embodiment, the ring has a stepped shape.

The previously described variants of further developments can be especially advantageous individually as well as in combination. All variants of further developments can be combined among themselves. A few possible combinations are explained in the description of the exemplary embodiments of the figures. However, these possibilities of combinations of variants of further developments that are shown in it are not final.

BRIEF DESCRIPTION OF THE DRAWINGS

The invention is explained in detail in the following by exemplary embodiments using the views in the drawings.

DETAILED DESCRIPTION

FIG. 1

Figure 1:
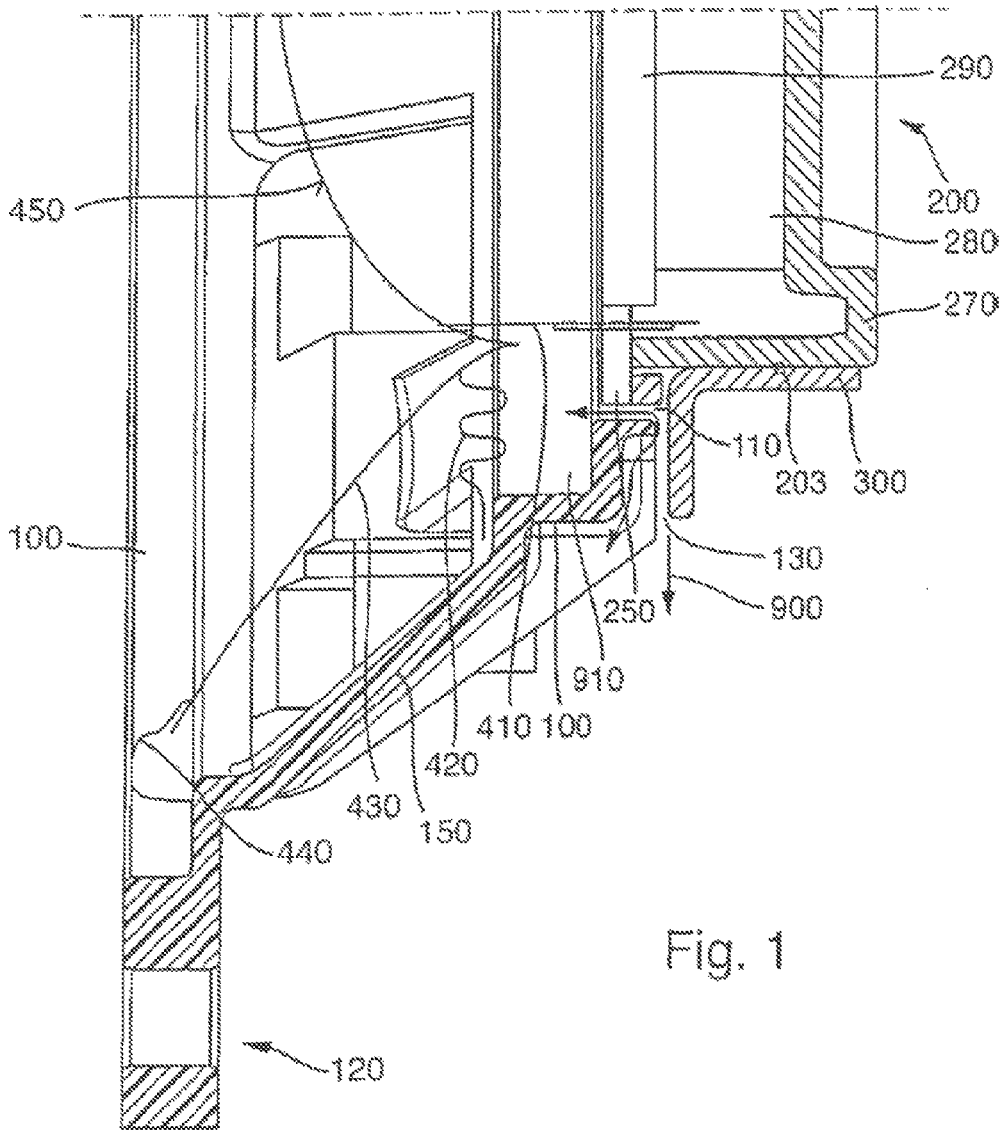
FIG. 1 shows a sectional view of a loudspeaker of an exemplary embodiment.

FIG. 1 shows a sectional view of a loudspeaker. The loudspeaker of FIG. 1 can be designated as a moving coil loudspeaker or a cone loudspeaker (or speaker cone). The loudspeaker with the design of FIG. 1 is constructed as a mid-range loudspeaker. The loudspeaker comprises a loudspeaker frame 100, a magnet 200, and a ring 300.

The loudspeaker frame 100 is formed from a plastic material, for example, by injection molding. The loudspeaker frame 100 is formed in the embodiment of FIG. 1 as a single piece.

The magnet 200 includes in the embodiment of FIG. 1 several components. The magnet 200 comprises a magnetic pot 270, a magnetic disk 280 and a pole disk 290. The magnetic pot 270 and with it, the outside of the magnet 200 are designed in a rotationally symmetrical manner. The magnet 200 has a shoulder 250. In the embodiment of FIG. 1, the shoulder 250 is simultaneously constructed as a pole disk. An oscillating coil (or voice coil) 410 that can be partially moved in the magnetic pot 270 is shown only schematically in the sectional view of FIG. 1.

The magnet 200 is fastened on the loudspeaker frame 100 including plastic by a ring 300. In the embodiment of FIG. 1, the ring 300 and the magnet 200 are mechanically fixed in a press fit 203. The ring 300 can be slightly widened for the fixing. In the press fit 203, the loudspeaker frame 100 is clamped between the shoulder 250 of the magnet 200 and the ring 300. The loudspeaker frame 100 advantageously has a rotationally symmetrical area that fills up an intermediate space between the shoulder 250 of the magnet 200 and the ring 300 in the press fit 203.

It can be ensured during the mounting of the ring 300 by an adjusted advance path, that the plastic of the loudspeaker frame 100 reliably rests on the shoulder 250 of the magnet 200 as well as on the ring 300. It can be ensured by a precise adjusting of the path-force fit that the plastic of the loudspeaker frame 100 is not pressed or destroyed between shoulder 250 and ring 300. An especially flat construction of the loudspeaker can be achieved by fastening the magnet 200 on the loudspeaker frame 100 by the ring 300 so that, for example, a construction space in depth can be reduced in a motor vehicle door.

In addition to the fastening, the ring 300 has other functions in synergy. The ring 300 is constructed in the embodiment of FIG. 1 as a heat sink for reducing a thermal resistance between the magnet 200 and the ambient air. An electrical loss in the oscillating coil 410 produces heat, the greatest part of which is received by the magnet 200. The heated magnet 200 dissipates this heat via its surface to the ambient air. As a cooling body the ring 300 enlarges the surface of the magnet 200 emitting the heat.

In the embodiment of FIG. 1, a volume 910 is formed by a number of walls of the loudspeaker frame 100 and of a centering 420 and of the oscillating coil 410. The centering 420 is fastened on the loudspeaker frame 100 and with the oscillating coil 410 on a membrane (or diaphragm) 430 and a cover cap 450 of the loudspeaker. In order that the membrane 430 can freely oscillate, it is fastened by a stiffening corrugation (or bead) on the plastic speaker frame 100. The plastic speaker frame 100 comprises webs 150 in the area of the membrane 430 in order to make a free oscillation of the membrane 430 possible. In FIG. 1 the section is precisely shown by one of the webs 150.

The section in the view of FIG. 1 also runs through a screwing point 120. The entire loudspeaker can be fastened by the screwing point 120. The loudspeaker of the embodiment of FIG. 1 is advantageously provided for the separation of the wet-dry space, in particular in a vehicle. For example, the loudspeaker seals an opening in a module carrier in a motor vehicle door. The separation between the wet space and the dry space takes place here by the loudspeaker frame 100, the stiffening corrugation 440, the membrane 430 and the cover cap 450.

The loudspeaker frame 100 has a number of openings 110 in the area of the magnet 200 that are covered by the ring 300. An opening 110 is shown in section in the embodiment of FIG. 1. A plurality of openings 110 are advantageously provided.

During the operation of the loudspeaker, air flow 900 is produced by the movement of the membrane 430 and of the centering 420 and is schematically represented in FIG. 1. The air flow 900 passes through the number of openings 110. This air flow 900 brings about a cooling by convection and therefore a heat dissipation in the vicinity of the oscillating coil 410 so that the loudspeaker can be operated with a higher performance. In addition, a convection is produced along a surface of the ring 300.

A slot 130 is formed in the press fit 203 in the area of the number of openings 110 between the loudspeaker frame 100 and the ring 300. The air flow 900 is also conducted through the slot 130. The slot 130 can be produced to be narrower by the press fit 203 than a slot in the loudspeaker frame 100 that is manufactured by simple injection molding technology. A penetration of foreign particles into the volume 910 can be significantly reduced by the low (or small) dimensions of the slot 130. The use of dirt-repellent substances (grid substance, cotton) is not necessary.

FIG. 2

Figure 2:
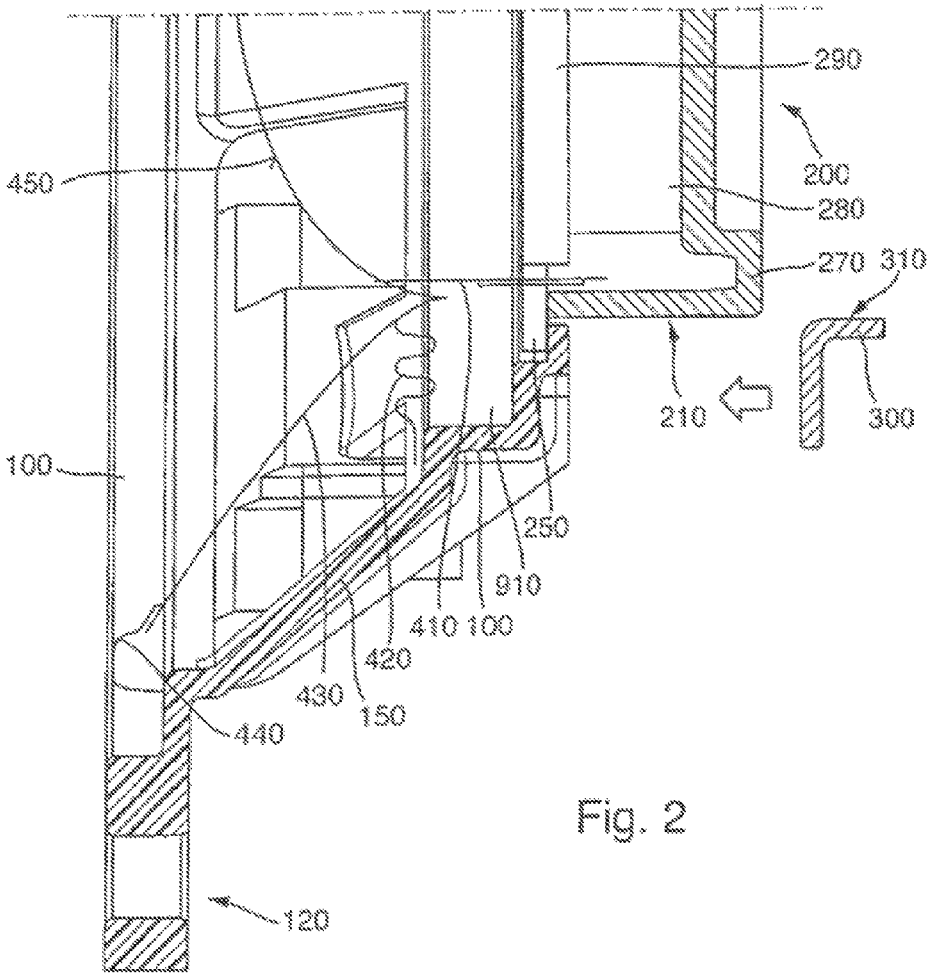
FIG. 2 shows a sectional view of a loudspeaker of another exemplary embodiment.

FIG. 2 shows another embodiment of a loudspeaker in a sectional view. The loudspeaker also comprises a loudspeaker frame 100, a magnet 200 and a ring 300. The ring 300 is shown in the embodiment of FIG. 2 in a position before the mounting. An arrow indicates the direction of mounting for the ring 300.

The ring 300 has an inner surface 310 designed to form a press fit with an outer surface 210 of the magnet 200. In contrast to the embodiment of FIG. 1, the ring 300 in FIG. 2 has a different shape so that a contact surface between the inner surface 310 of the ring 300 and the outer surface 210 of the magnet 200 is reduced. Consequently, a lesser advance (or feed) force for the mounting is necessary in the embodiment of FIG. 2. A press fit can be very precisely produced by a tolerance pairing that is defined by the outer surface 210 of the magnet 200 and of the inner surface 310 of the ring 300.

The outer surface 210 of the magnet 200 is advantageously produced by extrusion or turning. This can significantly improve the precision of the manufacturing for the press fit. The inner surface 310 of the ring 300 and the outer surface 210 of the magnet 200 are advantageously formed conically for the press fit.

The ring 300 advantageously has the same material as the magnet 200 in the area of its outer surface 210. Different expansions of the magnet 200 and the ring 300 are avoided conditioned by the same coefficient of thermal expansion. In addition, a good heat transfer between the magnet 200 and the ring 300 can be effected. The ring 300 advantageously includes steel sheeting. For the manufacture the ring 300 is stamped out and subsequently deep-drawn. In the embodiment of FIG. 2 the ring 300 is deep-drawn in an L-shape. Alternatively, the ring 300 can be deep-drawn in a stepped shape, wherein a stepped surface of the ring 300 projects over a transition (slot, boundary surface) between the loudspeaker frame 100 and the magnet 200.

The invention is not limited to the variants of embodiments of the FIGS. 1 and 2 shown. For example, it is possible to provide another shape of the ring. The ring is advantageously formed as a cap in order to protect the slot from sprayed water. It is also possible to provide another shape for the loudspeaker frame or to provide a loudspeaker frame including another material. The heat resistance of the ring can be further lowered by additional ribs or lamellas. The functionality of the loudspeaker for the separation of the wet-dry space according to FIG. 1 can be used especially advantageously for a motor vehicle.

What is claimed is:

1. A loudspeaker comprising:

a loudspeaker frame, a magnet, and a ring, wherein the magnet has an outer surface, wherein the magnet has a shoulder, wherein the ring has an inner surface that is constructed so as to form a press fit with the outer surface of the magnet, wherein in the press fit, the loudspeaker frame is clamped between the shoulder of the magnet and the ring, and wherein the ring is constructed as a heat sink for reducing a thermal resistance between the magnet and an ambient air.

2. The loudspeaker of claim 1 wherein the ring includes a material that is the same as a material of the magnet in an area of the outer surface of the magnet.

3. The loudspeaker of claim 1 wherein the loudspeaker frame comprises a number of openings in an area of the magnet that are covered by the ring.

4. The loudspeaker of claim 3 wherein the press fit includes a slot that is formed in an area of the number of openings between the loudspeaker frame and the ring.

5. The loudspeaker of claim 1 wherein the magnet comprises a magnetic pot and wherein the magnetic pot forms at least one of the outer surface and the shoulder.

6. The loudspeaker of claim 1 wherein the outer surface is produced by turning or extrusion.

7. The loudspeaker of claim 1 wherein the ring is formed by deep drawing.

8. The loudspeaker of claim 1 wherein the ring is formed from steel sheeting.

9. The loudspeaker of claim 1 wherein the ring is L-shaped.

10. The loudspeaker of claim 1 wherein the ring has a stepped shape.

11. A loudspeaker comprising:

a loudspeaker frame;

a magnet including an outer surface and a shoulder; and a ring including an inner surface to form a press fit with the outer surface of the magnet; and wherein the press fit includes a slot that is formed in an area between the loudspeaker frame and the ring, and wherein the ring is constructed as a heat sink for reducing a thermal resistance between the magnet and an ambient air.

* * * * *